US006264536B1

(12) United States Patent
Crevasse et al.

(10) Patent No.: US 6,264,536 B1
(45) Date of Patent: Jul. 24, 2001

(54) REDUCING POLISH PLATEN CORROSION DURING INTEGRATED CIRCUIT FABRICATION

(75) Inventors: Annette M. Crevasse, Apopka; William G. Easter, Orlando; John A. Maze, III, Orlando; Sailesh M. Merchant, Orlando; Frank Miceli, Orlando, all of FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/496,115

(22) Filed: Feb. 1, 2000

(51) Int. Cl.[7] ..... B24B 1/00
(52) U.S. Cl. ..... 451/41; 457/285; 457/905
(58) Field of Search ..... 451/285–289, 451/41, 905, 548, 550; 438/892–893

(56) References Cited

U.S. PATENT DOCUMENTS 5,183,402 * 2/1993 Cooke et al. ..... 432/5
5,558,717 * 9/1996 Zhao et al. ..... 118/715
5,743,788 * 4/1998 Vanell ..... 451/41

* cited by examiner

*Primary Examiner*—Joseph J. Hail, III
*Assistant Examiner*—George Nguyen
(74) *Attorney, Agent, or Firm*—Steve Mendelsohn

(57) ABSTRACT

A technique for reducing corrosion over a steel platen used during semiconductor wafer polishing. An anodic metal plate is attached to the steel platen to cathodically protect the surface of the steel platen via an electrochemical process. This cathodic protection inhibits the formation of localized anodic sections formed on the steel platen. Since the steel platen now has fewer, if any, localized anodic sections present in the prior art, the steel platen is less likely to corrode. The anodic metal may be made of an inexpensive metal material such as magnesium, aluminum, or some other appropriate metal. The metal plate is also replaceable in nature, i.e., it may be replaced after the metal plate has been corroded.

23 Claims, 2 Drawing Sheets

REDUCING POLISH PLATEN CORROSION DURING INTEGRATED CIRCUIT FABRICATION

BACKGROUND OF THE INVENTION

1. Field of the Invention

The present invention relates to integrated circuit fabrication, and, more particularly, to chemical mechanical polishing of semiconductor wafers.

2. Description of the Related Art

Fabrication of a multi-level integrated circuit involves numerous processing steps. After impurity regions have been deposited within a semiconductor substrate and gate areas have been defined upon the substrate, a metal interconnect is placed on the semiconductor topography and connected to contact areas thereon. An interlevel dielectric is then deposited upon and between the metal interconnect, and more contact areas are formed through the dielectric to the interconnect routing. A second level of metal interconnect may then be placed upon the interlevel dielectric and coupled to the first level of metal interconnect via the contact areas arranged within the dielectric. Additional levels of metal interconnect and interlevel dielectric may be formed if desired.

Stacking metal interconnect levels relies on photolithography to align different levels of metal interconnect that make up an integrated circuit. In photolithography, alignment of the different features on the surface of the wafer is used to pattern the next level and create a working device. Due to the depth of focus limitations in photolithography, it is critical that the surface being patterned is as flat as possible. Unfortunately, unwanted surface irregularities may form in the topological surface of one or more layers of an integrated circuit. For example, a recess may result during the formation of conductive plugs which extend through an interlevel dielectric. Plug formation involves forming an opening through an interlevel dielectric and depositing a conductive material into that opening and across the interlevel dielectric. A recess may form in the upper surface of the conductive material since deposition occurs at the same rate upon the bottom of the opening as upon the sides of the opening. The formation of such recesses can lead to various problems during integrated circuit fabrication. For instance, step coverage may result from large thickness topography. Step coverage is defined as a measure of how well a film conforms over an underlying step and is expressed by the ratio of the minimum thickness of a film as it crosses a step to the nominal thickness of the film on horizontal regions. In general, the height of the step, e.g., the depth of the recess, and the aspect ratio of the features being covered, e.g., the depth-to-width ratio of the recess, affects the step coverage. The greater the step height or the aspect ratio, the more difficult it is to achieve coverage of the step without a corresponding thinning of the film that overlies the step.

The concept of utilizing chemical and mechanical abrasion to remove surface irregularities and create a planar surface is known as chemical-mechanical polishing ("CMP"). A typical CMP process involves pressing a substrate, e.g., a semiconductor wafer device upside-down against a moving polishing pad which is adhesively attached to a rotatable steel table or steel platen. The steel platen provides rigidity and mechanical support to the polishing pad. A suspension of abrasive particles in a liquid often referred to as a "slurry," is deposited upon the pad possibly through a nozzle such that the slurry becomes disposed at the interface between the pad and the wafer surface. The slurry initiates the polishing process by chemically reacting with the surface material being polished. The polishing process is facilitated by pressure between the pad and the wafer to remove material catalyzed by the slurry or mechanically remove materials from the pad without slurry catalysis. Thus, through both chemical and mechanical reactions, excess material is removed from the wafer.

The polishing pad may be made of various substances. Typically, it is desirable to use a polishing pad that is both resilient and, to a lesser extent, conformal. The selection of pad properties such as weight, density, and hardness often depends on the material being polished. A popular polishing pad comprises polyurethane. An example of a relatively hard polishing pad is the IC-1000™ type pad commercially available from Rodel Products Corporation of Newark, Del. A relatively soft pad is the SUBA 500™ type pad, also manufactured by Rodel Products Corporation. Polishing pads used for wafer planarization may undergo a reduction in polishing rate and uniformity due to loss of surface roughness. Furthermore, the pores of polishing pads may become embedded with slurry particles or polishing by-product. If the pores remain blocked over a substantial period of time, a condition known as "glazing" occurs. Glazing results when enough particles build up on the polishing pad surface such that the wafer surface begins to hydroplane over the surface of the pad. Hydroplaning eventually leads to substantially lower removal rates in the glazed areas, and, in some cases, to mechanical scratching.

A method known as pad conditioning is generally used to counter smoothing or glazing of the polishing pad surface and to achieve a stable polishing rate. Pad conditioning is herein defined as a technique used to maintain the polishing pad surface in a state which enables proper polishing of a topological surface. Pad conditioning is typically performed by mechanically abrading the pad surface in order to renew that surface. Such mechanical abrasion of the pad surface may roughen the surface and remove particles which are embedded in the pores of the polishing pad. Opening the pores permits the entrance of slurry into the pores during CMP to enhance polishing. Additionally, the open pores provide more surface area for polishing.

The current practice of utilizing slurries during CMP and pad conditioning causes corrosion effects on the steel platen. The slurry may comprise different chemicals including acidic materials, basic materials, and oxidizers. Generally when the acidic/oxidized components of a slurry remain in contact with the steel platen, e.g., the steel platen remains emerged in the slurry, the steel platen becomes susceptible to corrosion. Even though the polishing pad covers the steel platen, the steel platen corrodes over time due to localized cathodic and anodic sections being formed on the steel platen. Corrosion can contribute to several material defects in the steel platen leading to weakened structure and cracks. Ultimately, the corrosion may completely reduce the usefulness of the steel platen, in which case the steel platen must be replaced with a new steel platen. Steel platens are generally expensive, and thus each replacement of a steel platen increases the dollar cost. Furthermore, the replacement of a steel platen causes system downtime wherein production must be stopped, thereby further increasing dollar cost. Also, the corrosion may leak to the actual semiconductor wafer, thereby ruining the wafer completely.

SUMMARY OF THE INVENTION

The present invention is directed to a technique for reducing corrosion over a steel platen used during semiconductor wafer polishing. In accordance with one embodiment, an anodic metal plate is attached to the steel platen to cathodically protect the surface of the steel platen via an electrochemical process. This cathodic protection inhibits the formation of localized anodic sections formed on the steel platen. Since the steel platen now has fewer, if any, localized anodic sections present in the prior art, the steel platen is less likely to corrode.

The anodic metal may be made of an inexpensive metal material such as magnesium, zinc aluminum, or some other appropriate metal. The metal plate is also replaceable in nature, i.e., it may be replaced after the metal plate has been corroded.

In one embodiment, the present invention is a method for polishing an integrated circuit using a rotating polishing pad mounted on a metal platen, comprising the step of: (a) attaching an anodic conducting material to the metal platen; (b) introducing a chemically reactive slurry onto the rotating polishing pad; and (c) pressing the integrated circuit against the rotating polishing pad with the chemically reactive slurry interposed there between to polish a surface of the integrated circuit, wherein the anodic conducting material inhibits corrosion of the metal platen by the chemically reactive slurry.

In another embodiment, the present invention is an apparatus for polishing an integrated circuit, comprising: (a) a rotatable metal platen; (b) a polishing pad mounted on the metal platen to rotate with the metal platen; and (c) an anodic conducting material attached to the metal platen, wherein the integrated circuit is polished by: (1) introducing a chemically reactive slurry onto the rotating polishing pad; and (2) pressing the integrated circuit against the rotating polishing pad with the chemically reactive slurry interposed there between to polish a surface of the integrated circuit, wherein the anodic conducting material inhibits corrosion of the metal platen by the chemically reactive slurry.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
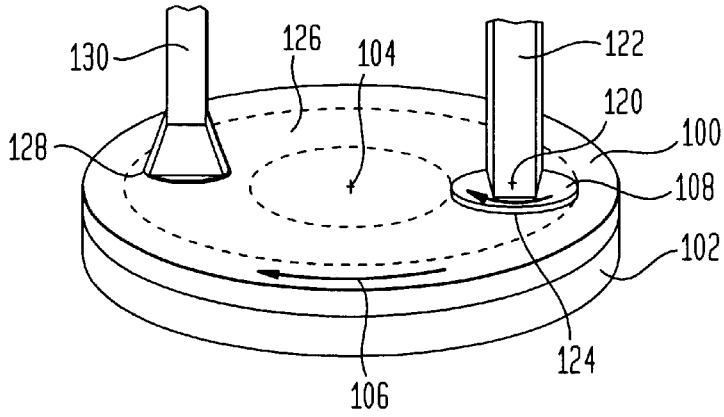
FIG. 1 (PRIOR ART)
FIG. 1 illustrates an example in which a polishing pad is conditioned concurrent with wafer polishing.

An example in which a polishing pad is conditioned concurrent with wafer polishing is shown in FIG. 1. FIG. 1 provides a prospective view of a polishing pad 100 mounted on a rotatable steel platen 102. Steel platen 102 and polishing pads 100 rotate about a central axis 104 along the direction shown by arrow 106. Water carrier 108, which holds wafer 124, is usually directed downwards against pad 100. Wafer carrier 108 is configured at the end of arm 122 to rotate about axis 120. Wafer carrier 108 is mounted such that the frontside surface abuts pad 100, the frontside surface embodying numerous topological features resulting during integrated circuit device fabrication. Wafer carrier 108 rotates about axis 120 along arrow 124 within a plane parallel to the plane formed by the polishing surface of pad 100.

As pad 100 rotates, wafer carrier 108 contacts a portion of the polishing surface, denoted as a circular track 126 defined by the rotational movement of pad 100. Track 126 is conditioned during wafer polishing by a conditioning head 128. Conditioning head 128 is mounted on a movable arm 130 which can swing in position over track 126 commensurate with arm 122. Arm 130 presses an abrasive surface of conditioning head 128 against the polishing surface of pad 100 predominantly within track 126 as pad 100 rotates about axis 104. During this process, protrusions on the abrasive downward-facing surface of head 128 extend toward the surface of polishing pad 100. Particles embedded in the pores of pad 100 are thus removed from the pad and flushed with slurry across the pad surface. As the slurry is introduced (not shown), the removed particles are rinsed over the edges of the polishing pad into a drain (not shown). Removing the particles from the polishing pad inhibits glazing of the pad surface. The abrasive surface of conditioning head 128 may also function to roughen the surface of pad 100. FIG. 1 illustrates conditioning concurrent with wafer polishing; however, it is recognized that conventional conditioning can occur either before or after wafer polishing.

Figure 2A:
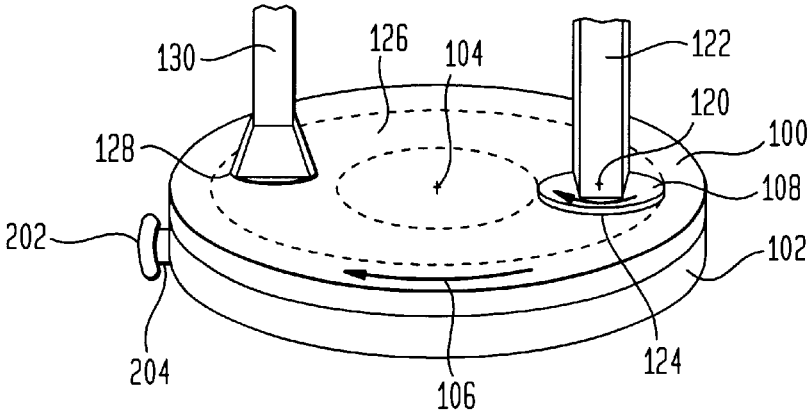
FIGS. 2A–2C illustrate exemplary embodiments of the present invention.
Figure 2B:
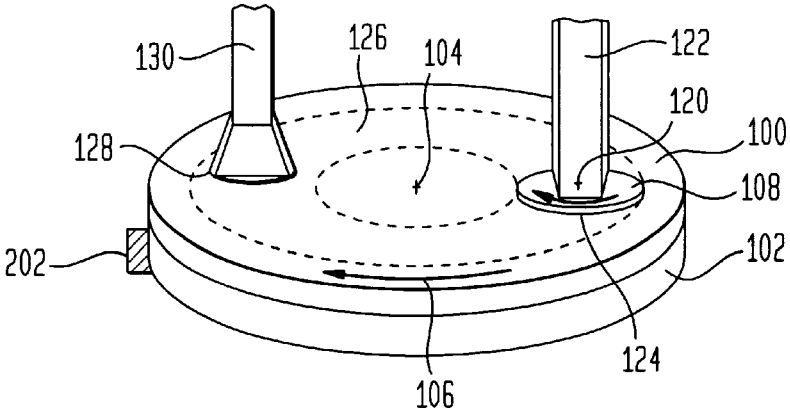
Figure 2C:
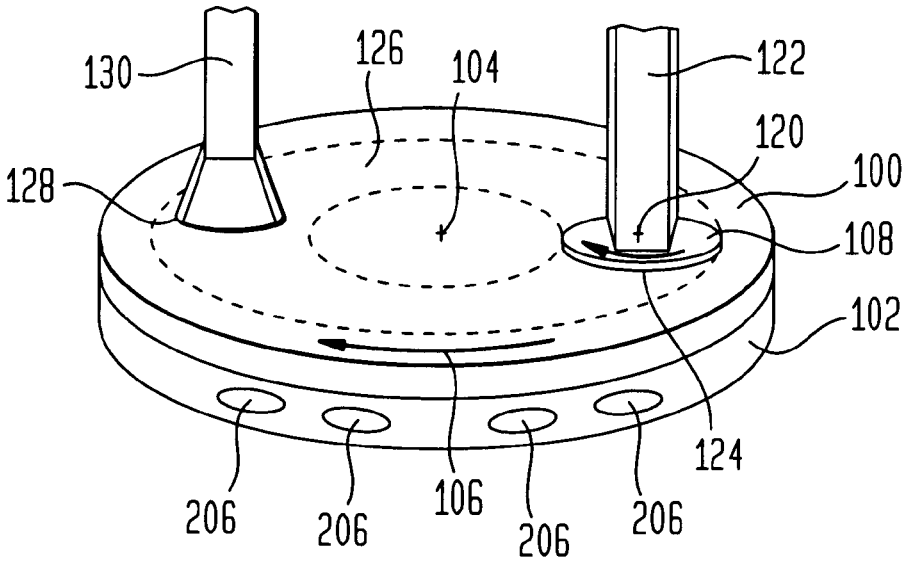

FIGS. 2A–2C illustrate exemplary embodiments of the present invention. In FIG. 2A, a detachable anodic metal plate 202 is attached to steel platen 102 via some detachable means 204. Detachable means are usually made of a conducting metal. The detachable means can also be non-metal as long as anodic metal plate 202 touches steel platen 102. FIG. 2A illustrates a gap between the anodic metal slate and the steel platen. Such gap is permitted only if detachable means 204 are made of conducting metal. If detachable means are made of non-conducting metal, such gap is not permitted. These detachable means may be, for example, screws latches, braces, or bolts. Furthermore, as shown in FIG. 2B, metal plate 202 may be directly coupled to steel platen. For example, metal plate 202 may be welded to the steel platen. In another embodiment, as shown in 1FIG. 2C, recesses or grooves may be created on the platen, e.g., on the side of the platen. One or more metal plates 202 may then be embedded within these recesses 206. During replacement, metal plates 202 may be removed from the recesses and new metal plates with similar size and shape may be inserted in the recesses.

Even though FIGS. 2A and 2B illustrate use of only one metal plate 202, in practice more than one plate may be used. The use of more than one plate may increase the dollar cost, but, in return, a greater protection is provided and the metal plates may not need to be replaced as often. Yet in one more embodiment (not shown), one or more anodic metal plates 202 may be embedded in the surface of the steel platen covered by the conditioning pad. In this embodiment, anodic metal plates are part of the top surface of the steel platen.

The purpose of metal plate 202 is to reduce the corrosion on steel platen 102 by corroding preferentially. Metal plate 202 acts as a focal anode terminal and therefore absorbs most of the corrosion. Metal plate 202 is preferably made of some inexpensive material and, after metal plate 202 has corroded the metal plate can be replaced by detaching the corroded plate 202 (e.g., via detachable means 204 of FIG. 2A), and attaching a new metal plate 202.

The size and shape of metal plate 202 depends upon the size and shape of steel platen 102. Generally, metal plate 202 should be a sufficient size to provide the necessary cathodic protection on steel platen 102.

Figure 3:
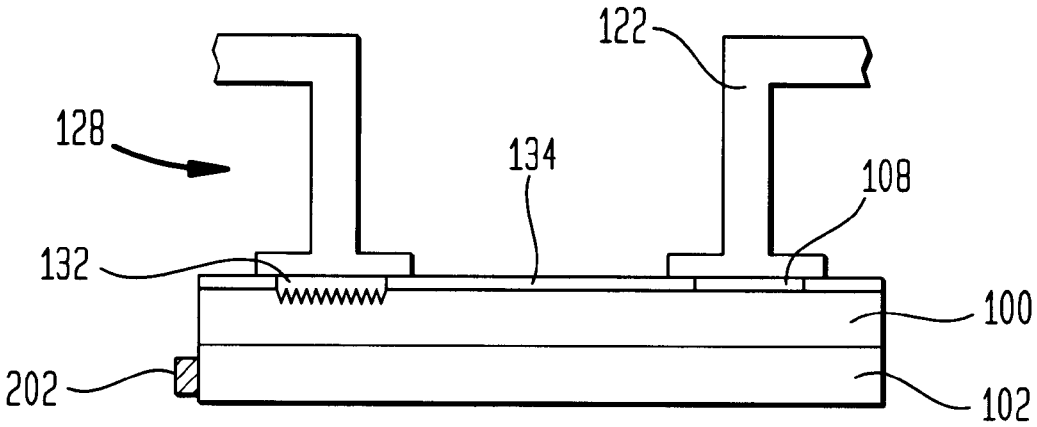
FIG. 3 depicts a cross-sectional view of the CMP and conditioning process illustrated in FIGS. 2A–2C.

FIG. 3 depicts a cross-sectional view of the CMP and conditioning process illustrated in FIG. 2A. More specifically, FIG. 3 illustrates the abrasive surface 132 formed at the lower end of conditioning head 128. Abrasive surface 132 has a plurality of protrusions interspersed with recesses. The relative spacing of the protrusions and recesses depends on the desired conditioning effect. Abrasive surface 132 preferably contacts the surface of pad 100 commensurate with wafer 108. More particularly, abrasive surface 132 extends below the upper surface of slurry film 134 to dislodge depleted slurry particles and/or wafer polish by-products from the pores of pad 100. Metal plate 202 is coupled to steel platen 102 via detachable means 204 and matches the shape of steel platen 102. After metal plate 202 has been corroded, metal plate 202 may be detached via means 204 and a new metal plate may be attached. Since metal plates 202 are preferably made of inexpensive materials, the user may choose to change metal plates often or after pre-determined periods of time.

The attachment of anodic metal plate 202 to steel platen 102 results in cathodic protection of steel platen 102. To achieve a desired level of cathodic protection, it is necessary that anodic metal plate 202 is selected as a dissimilar metal from steel platen 102 in the galvanic series. Cathodic protection results from cathodic polarization of a corroding metal surface to reduce the corrosion rate. For example, for iron corroding in a dilute neutral electrolyte solution, the respective anode and cathode reactions are:

$$Fe \rightarrow Fe^{2+} + 2e^- \quad (1)$$

$$O_2 + 2H_2O + 4e^- \rightarrow 4OH^- \quad (2)$$

Cathodic polarization of the above-mentioned corrosion reduces the rate of the half-cell reaction (1) with an excess of electrons which drives the equilibrium from right to left. The excess of electrons also increases the rate of oxygen reduction and $OH^-$ production by reaction (2) in a similar manner during cathodic polarization.

Reaction (1) could be replaced by the anodic reaction for any metal, and the corrosion rate of any metal can be reduced by cathodic polarization. The more noble (positive) metal in a galvanic couple is cathodically polarized, while the active metal is anodically dissolved. Thus, a metal can be cathodically protected by connection to a second metal, called a sacrificial anode terminal, having a more active corrosion potential. The second metal must be periodically replaced as they are consumed by anodic dissolution.

In general, the sacrificial anode terminal has a more active corrosion potential, and during the process of cathodic protection, the sacrificial anode terminal is consumed by anodic dissolution, and the cathode terminal is cathodically protected. The cathodic protection process involves the flow of electrons from the anode terminal to the cathode terminal. To initiate the process of cathodic protection, there must be an electrical contact between the anode terminal and the cathode terminal, and there must be a conductive electrolyte present to facilitate the flow of current between the terminals.

In the present invention, anodic metal plate 202 acts as a sacrificial anode terminal, and steel platen 102 acts as a cathode terminal. The attachment means 204 provides the necessary electrical contact, and the slurry acts as a conducting electrolyte solution. The cathodic protection process starts by electrons flowing from anodic metal plate 202 to the steel platen 102.

The anodic reaction at steel platen 102 is reduced by the surplus of the electrons provided by anodic metal plate 202. Thus, localized anodic sections are inhibited from forming on steel platen 102. Anodic metal plate 202 continues to absorb the corrosion caused by CMP and pad conditioning, thereby reducing corrosion of steel platen 102. After anodic metal plate 202 is dissolved to a pre-determined shape/size/dimension, the corroded metal plate 202 may be replaced with a new metal plate.

It will be further understood that various changes in the details, materials, and arrangements of the pails which have been described and illustrated in order to explain the nature of this invention may be made by those skilled in the ail without departing from the scope of the invention as expressed in the following claims.

What is claimed is:

1. A method for polishing an integrated circuit using a rotating polishing pad mounted on a metal platen, comprising the step of:

(a) attaching an anodic conducting material to the metal platen;

(b) introducing a chemically reactive slurry onto the rotating polishing pad; and (c) pressing the integrated circuit against the rotating polishing pad with the chemically reactive slurry interposed there between to polish a surface of the integrated circuit, wherein the anodic conducting material inhibits corrosion of the metal platen by the chemically reactive slurry.

2. The invention of claim 1, wherein the anodic conducting material is removably attached to the metal platen.

3. The invention of claim 2, further comprising the step of replacing the anodic conducting material after the anodic conducting material becomes corroded by the chemically reactive slurry.

4. The invention of claim 1, wherein the anodic conducting material comprises one or more metal plates attached to one or more positions along a side surface of the metal platen.

5. The invention of claim 4, wherein the anodic conducting material comprises a plurality of metal plates attached to a plurality of positions along the side surface of the metal platen.

6. The invention of claim 4, wherein the metal platen has one or more recesses at the one or more positions along the side surface of the metal platen and the one or more metal plates are inserted into the one or more recesses.

7. The invention of claim 6, wherein the metal platen has a plurality of recesses at a plurality of positions along the side surface of the metal platen and the plurality of metal plates are inserted into the plurality of recesses.

8. The invention of claim 1, wherein the anodic conducting material electrochemically inhibits corrosion of the metal platen by the chemically reactive slurry.

9. An apparatus for polishing an integrated circuit, comprising:

(a) a rotatable metal platen;

(b) a polishing pad mounted on the metal platen to rotate with the metal platen; and (c) an anodic conducting material attached to the metal platen, wherein the integrated circuit is polished by:

(1) introducing a chemically reactive slurry onto the rotating polishing pad; and (2) pressing the integrated circuit against the rotating polishing pad with the chemically reactive slurry interposed there between to polish a surface of the integrated circuit, wherein the anodic conducting material inhibits corrosion of the metal platen by the chemically reactive slurry.

10. The invention of claim 9, wherein the anodic conducting material is removably attached to the metal platen.

11. The invention of claim 10, the anodic conducting material is removably attached to the metal platen to enable replacing the anodic conducting material after the anodic conducting material becomes corroded by the chemically reactive slurry.

12. The invention of claim 9, wherein the anodic conducting material comprises one or more metal plates attached to one or more positions along a side surface of the metal platen.

13. The invention of claim 12, wherein the anodic conducting material comprises a plurality of metal plates attached to a plurality of positions along the side surface of the metal platen.

14. The invention of claim 12, wherein the metal platen has one or more recesses at the one or more positions along the side surface of the metal platen and the one or more metal plates are inserted into the one or more recesses.

15. The invention of claim 14, wherein the metal platen has a plurality of recesses at a plurality of positions along the side surface of the metal platen and the plurality of metal plates are inserted into the plurality of recesses.

16. The invention of claim 9, wherein the metal platen has a plurality of recesses at a plurality of positions along the top surface of the metal platen and a plurality of metal plates are inserted into the plurality of recesses.

17. The invention of claim 9, wherein the anodic conducting material electrochemically inhibits corrosion of the metal platen by the chemically reactive slurry.

18. A method for polishing an integrated circuit using a rotating polishing pad mounted on a metal platen, comprising the step of:

(a) attaching, to the metal platen, a material whose potential is substantially more anodic than the platen, wherein, when the material and the platen are electrically coupled together, the potential of the material drives the platen to a cathodic state;

(b) introducing a chemically reactive slurry onto the rotating polishing pad; and (c) pressing the integrated circuit against the rotating polishing pad with the chemically reactive slurry interposed there between to polish a surface of the integrated circuit, wherein the material electrochemically inhibits corrosion of the metal platen by the chemically reactive slurry.

19. The invention of claim 18, wherein the material is removably attached to the metal platen.

20. The invention of claim 18, wherein the material comprises one or more metal plates attached to one or more positions along a side surface of the metal platen.

21. An apparatus for polishing an integrated circuit, comprising:

(a) a rotatable metal platen;

(b) a polishing pad mounted on the metal platen to rotate with the metal platen; and (c) a material attached to the metal platen and whose potential is substantially more anodic than the platen, wherein, when the material and the platen are electrically coupled together, the potential of the material drives the platen to a cathodic state, wherein the integrated circuit is polished by:

(1) introducing a chemically reactive slurry onto the rotating polishing pad; and (2) pressing the integrated circuit against the rotating polishing pad with the chemically reactive slurry interposed there between to polish a surface of the integrated circuit, wherein the material electrochemically inhibits corrosion of the metal platen by the chemically reactive slurry.

22. The invention of claim 21, wherein the material is removably attached to the metal platen.

23. The invention of claim 21, wherein the material comprises one or more metal plates attached to one or more positions along a side surface of the metal platen.

* * * * *